US011952760B2

(12) United States Patent
Düsterhus et al.

(10) Patent No.: US 11,952,760 B2
(45) **Date of Patent: *Apr. 9, 2024**

(54) SINK HAVING A SEPARATE INSERT PLATE THAT IS TILTABLE

(71) Applicant: BSH Hausgeräte GmbH, Munich (DE)

(72) Inventors: Jürgen Düsterhus, Detmold (DE); Andreas Wölfler, Saalfelden (AT); Benjamin Reu, Prien am Chiemsee (DE)

(73) Assignee: BSH Hausgeräte GmbH, Munich (DE)

( * ) Notice: Subject to any disclaimer, the term of this patent is extended or adjusted under 35 U.S.C. 154(b) by 10 days.

This patent is subject to a terminal disclaimer.

(21) Appl. No.: 17/777,067

(22) PCT Filed: Nov. 11, 2020

(86) PCT No.: PCT/EP2020/081726
§ 371 (c)(1),
(2) Date: May 16, 2022

(87) PCT Pub. No.: WO2021/104868
PCT Pub. Date: Jun. 3, 2021

(65) Prior Publication Data

US 2022/0403634 A1 Dec. 22, 2022

(30) Foreign Application Priority Data

Nov. 29, 2019 (DE) ..... 102019218642.4

(51) Int. Cl.
*E03C 1/186* (2019.01)
*E03C 1/181* (2019.01)

(52) U.S. Cl.
CPC ..... *E03C 1/186* (2013.01); *E03C 1/181* (2013.01)

(58) Field of Classification Search
CPC ..... E03C 1/181; E03C 1/186; A47B 77/06; A47L 19/02; A47L 17/02; A47J 47/20
See application file for complete search history.

(56) References Cited

U.S. PATENT DOCUMENTS 3,346,886 A * 10/1967 Kashiwamura ..... E03C 1/186 108/134
3,882,553 A 5/1975 Poiencot
(Continued)

FOREIGN PATENT DOCUMENTS

CN 106579805 A 4/2017
CN 206090741 U 4/2017
(Continued)

OTHER PUBLICATIONS

National Search Report DE 10 2019 218 642.4 dated Aug. 21, 2020.
International Search Report PCT/EP2020/081726 dated Jan. 25, 2021.

*Primary Examiner* — Erin Deery
(74) *Attorney, Agent, or Firm* — Michael E. Tschupp; Andre Pallapies; Brandon G. Braun

(57) ABSTRACT

A sink includes a basin including a bottom wall and adjoining side walls which delimit a receiving space. An insert plate separate from the basin is inserted into the receiving space, and a lifting apparatus moves the insert plate relative to the basin. The lifting apparatus includes a lifting unit with a lifting device to move the insert plate in a vertical direction. The lifting apparatus includes a tilting device configured to perform a tilting movement of the insert plate relative to a horizontal plane.

20 Claims, 5 Drawing Sheets

(56) References Cited

U.S. PATENT DOCUMENTS

| | | | |
|---|---|---|---|
| 2005/0067747 | A1 | 3/2005 | Erickson |
| 2020/0385969 | A1 | 12/2020 | Song |

FOREIGN PATENT DOCUMENTS

| | | | | | |
|---|---|---|---|---|---|
| CN | 109695275 | A | * | 4/2019 | |
| CN | 109695275 | A | | 4/2019 | |
| CN | 111379291 | A | * | 7/2020 | ..... E03C 1/0402 |
| DE | 3621151 | A1 | | 1/1988 | |
| DE | 202010007075 | U1 | | 10/2010 | |
| KR | 200395242 | Y1 | * | 9/2005 | |
| WO | 2011128856 | A1 | | 10/2011 | |

* cited by examiner

SINK HAVING A SEPARATE INSERT PLATE THAT IS TILTABLE

CROSS-REFERENCES TO RELATED APPLICATIONS

This application is the U.S. National Stage of International Application No. PCT/EP2020/081726, filed Nov. 11, 2020, which designated the United States and has been published as International Publication No. WO 2021/104868 Al and which claims the priority of German Patent Application, Serial No. 10 2019 218 642.4, filed Nov. 29, 2019, pursuant to 35 U.S.C. 119(a)-(d).

The contents of International Application No. PCT/EP2020/081726 and German Patent Application, Serial No. 10 2019 218 642.4 are incorporated herein by reference in their entireties as if fully set forth herein.

BACKGROUND OF THE INVENTION

One aspect of the invention relates to a sink with a basin. The basin has a bottom wall and adjoining side walls. The basin has a receiving space delimited by the walls. Moreover, the sink has an insert plate which is separate from the basin and which is inserted into the receiving space.

Such sinks are known. Thus a sink which has a basin is disclosed, for example, in US 2005/0067747 A1. A base which is configured in one piece with the basin bottom and which extends upwardly is configured on the basin bottom. A plate may be attached to this base. As a result, a cutting board is formed on which objects, such as food, may be chopped. Such an embodiment is disadvantageous in that the integrated base is always present and thus a basic embodiment of the basin is complex in terms of shape and the configuration of the receiving space is restricted over the periphery. Moreover, it is always the case that the plate which is able to be positioned on the base is arranged only at one height level. The plate is only able to be positioned or removed by a user.

A sink is also disclosed in DE 362 1151 A1. Various inserts which may be inserted into the receiving space are provided separately from the basin. The inserts may be plates or further basin-like containers. These inserts may be positioned on the upper edge of the basin. The usability of a sink is also significantly limited thereby and the inserts have to be attached or removed by a user, and it is always the case that the inserts are able to be positioned only at one individual position.

BRIEF SUMMARY OF THE INVENTION

It is the object of the present invention to provide a sink with a basin and a separate insert plate, in which the insert plate is able to be positioned in a variable manner.

One aspect of the invention relates to a sink with a basin. The basin has a bottom wall and adjoining side walls. The basin also has a receiving space which is delimited by the bottom wall and the side walls. The receiving space is open at the top. The sink has an insert unit, in particular an insert plate, in particular a contiguous and non-perforated insert plate, which is separate from the basin. This insert plate is able to be inserted into the receiving space or is inserted therein. The sink also has a lifting apparatus, by means of which the insert plate is movable relative to the basin in the vertical direction of the sink. This is made possible by a physical lifting apparatus of the sink. Thus a sink is provided in which in principle the possibility is provided to arrange the insert unit at different vertical positions. This is also made possible by a lifting apparatus and does not have to be carried out manually by the user himself. In principle, it is possible that a continuous vertical adjustment of the insert plate is made possible by the lifting apparatus. Thus it is possible to approach and set many different height levels of the insert plate.

The lifting apparatus has a tilting device. A tilting movement of the insert plate relative to the horizontal plane may be carried out by this tilting device. Thus the insert plate is movable not only in a linear manner upwardly and downwardly in the vertical direction but, additionally or alternatively, a tilting movement may be carried out relative to a horizontal plane. Thus the insert plate may be moved in many different ways. In particular, a tilting movement is particularly advantageous in order to remove media, which are present on the upper face of the insert plate, by a tilted position. For example, this may be liquid media which have collected on the upper face of the insert plate. An automatic drainage of these liquid media from the upper face of the insert plate into the receiving space may be carried out by such a tilted position which is set by a tilting movement. Moreover, such a tilted position is also advantageous when the upper face of the insert plate is designed to be cleaned in the receiving space itself. For example, this may be carried out by a cleaning medium, such as water. By means of such a tilted position, it is thus possible to avoid the situation where the cleaning medium which is in contact with the upper face of the insert plate sprays significantly to the side. In particular, water from a faucet of the sink may thus be conducted onto the upper face of the insert plate with reduced spray when this insert plate is arranged in a defined tilted position. In particular, at least one tilted position for the insert plate relative to the horizontal plane may thus be set in a defined manner by means of the tilting device. It may also be provided that many different such tilted positions may be set. A continuous adjustment of the insert plate may be carried out, starting from the horizontal position into a tilted position. Preferably, in this case the tilting device is designed such that the insert plate is tiltable in any vertical position.

In an advantageous embodiment it is provided that the tilting device is a separate device from the lifting device. By means of such an embodiment, the individual movements may be carried out by independent devices. As a result, the individual devices, namely the lifting device and the tilting device, may be constructed in a simpler manner. This is both space-saving and cost-saving. Preferably, as a result, it is possible that during a displacement movement triggered by the lifting device the insert plate is able to be tilted at the same time by the tilting device.

In an advantageous embodiment it is provided that the lifting unit has a housing. In particular, the lifting device and the tilting device are arranged in the housing. As a result, on the one hand, a compact construction is achieved. On the other hand, both devices may be arranged in a protected manner in the lifting unit. The action of media located in the receiving space of the basin thus may be efficiently kept away from the lifting device and the tilting device.

Preferably, it is provided that the tilting device is a rod which is oriented in the vertical direction. In particular, this rod is arranged eccentrically to a center point of the insert plate. This is a particularly efficient design in order to be able to initiate a tilting movement of the insert plate in an accurate and simple manner. A particularly simple construction of such a tilting device is made possible thereby. Since the tilting device is changed due to its eccentric position and a position in the vertical direction, and in this regard force is exerted on the insert plate, this insert plate is pivoted or tilted, in particular about a horizontal axis, which runs in particular through the center point of the insert plate.

Preferably, a particularly space-saving device is provided by the embodiment of the tilting device as a rod.

In particular, it is provided that the tilting device is a telescopic rod. This telescopic rod is longitudinally adjustable in the vertical direction. Thus it may be pulled apart and pushed together. Such a telescopic rod is mechanically stable and is able to apply the corresponding lifting forces permanently. It is also of very compact construction. Last but not least, in such a telescopic rod the longitudinal adjustment is implemented by a relatively simple design. This also permits a permanently high degree of functionality and achieves a particularly low wear and tear of the tilting device.

Preferably, it is provided that the telescopic rod has at least two rod parts which are guided one inside the other. In particular, these rod parts are of conical configuration. This is an advantageous embodiment since an undesired decoupling of these two rod parts is thus avoided when the telescopic rod is pulled apart. Therefore, an anti-decoupling device is also formed by this conical shape of the rod parts.

In an advantageous embodiment it is provided that the upper rod part has at an upper end a first thread. This first thread engages in a second thread. This second thread is configured on a lower face of a plate of the sink. With a rotational movement of at least the upper rod part about a vertical rod axis, the insert plate is tiltable about the horizontal plane by means of the thread adjustment of the two coupled threads. An advantageous coupling between the upper rod part and the plate is made possible by means of such an embodiment. In particular, the plate is a plate receiver. The plate is configured, in particular, as a flat cylinder. The plate receiver is configured to receive the insert plate.

An undesired decoupling may also be avoided by means of such a mechanical coupling between the rod and this further component, in particular the plate receiver. A simple slippage of the rod out of the coupling point on the plate receiver is avoided thereby. Moreover, a very smooth and continuous uniform adjustment of the insert plate from the horizontal into a tilted position is made possible by such a design.

In an advantageous embodiment it may be provided that this second thread is configured in a through-hole of the plate receiver. Thus this second thread is configured, in particular, as an internal thread. Preferably, this through-hole through the plate receiver is covered by a resilient cover. As a result, it is possible to avoid the situation where contaminants could pass from above through the hole in the plate receiver and thus could pass into the interior of the housing of the lifting unit. In particular, it is achieved thereby that the tilting device and the lifting device, which are preferably arranged in the housing of the lifting unit, are protected from such contaminants. Since this cover is resilient, it may be deformed upwardly. If the upper rod part thus engages upwardly through this hole in the plate receiver, this resilient cover is deformed, in particular bulged, upwardly. Thus, due to this resilient deformation, it is also achieved that a corresponding movement force is exerted on the insert plate and this insert plate is tilted. In particular, such a path in the direction of the longitudinal axis, which extends in the vertical direction of the sink and about which the insert plate is lifted upwardly for tilting, when viewed in the direction of the longitudinal axis of the tilting device, is less than or equal to 5 mm, in particular less than or equal to 4 mm, in particular less than or equal to 3 mm. Preferably, however, this path is greater than 2 mm.

Preferably, it is provided that the plate receiver is integrated in the insert plate. However, it may also be provided that the plate receiver is a separate component from the insert plate. In particular, therefore, this plate receiver may be a separate bearing plate. This plate receiver may be arranged at an upper end of the upper lifting segment of the lifting unit. In particular, the plate receiver may be arranged at an upper end of an upper housing segment of the housing of the lifting unit. The plate receiver may also be connected directly to the upper lifting segment of the lifting device. In particular, in this context it may be mechanically in contact with an upper spindle of a lifting device which is configured as a spindle drive.

In an advantageous embodiment the second thread is configured in this plate receiver, in particular in the bearing plate.

Preferably, it is provided that the rod parts of the telescopic rod are configured with an anti-twist device. In particular, to this end the rod parts do not have a shape which is rotationally symmetrical about the rod axis. As a result, a rotation of the rod parts relative to one another about the rod axis is avoided. For example, such an external geometry of the rod parts may be a cylindrical shape with radial ribs. A relevant oval external geometry may also be formed. In particular, however, an edge geometry may also be provided. For example, this may be a multi-edge geometry. In particular, this may be a hexagonal geometry, for example. The relevant geometric shapes relative to the external contour of the rod parts are visible in a plane perpendicular to the rod axis.

In an advantageous embodiment it is provided that an upper end of the upper rod part is a pressure piece. In particular, this may be a resilient pressure piece. For example, this pressure piece may be a rubber cap. As a result, damage to the plate receiver and/or the insert plate may be avoided if the rod part were to be in mechanical contact directly with the plate receiver or directly with an insert plate. In particular, mechanical contact noises which might occur if this upper end of the upper rod part were to strike against the plate receiver or the insert plate, are also avoided or reduced thereby.

In an advantageous embodiment it is provided that the lifting apparatus has a first motor by means of which the lifting device is able to be driven. Thus the lifting device may be moved in a linear manner upwardly and downwardly in the vertical direction by this motor. Preferably, the lifting apparatus has a second motor which is separate from the first motor. The tilting device is able to be driven by this second motor. Since two separate motors are provided here, these motors may be designed individually for the requirements, on the one hand, of the lifting device and, on the other hand, of the tilting device. Moreover, in this regard the motors may be designed in each case to be smaller and thus may be individually installed at suitable points in a receiving housing of the lifting apparatus. A particularly compact construction with a maximum use of the space of the volume of the receiving housing is made possible thereby.

Last but not least, as a result the individual motors may also be individually serviced. For replacement purposes, therefore, it is not necessary to replace a larger complete motor but in each case to replace only a single individual motor.

Since the tilting device and the lifting device are spaced apart and lead into the receiving housing at different points from above, the coupling to the motors may also be carried out individually in this case. In the case of a single motor, this would have to be designed individually in order to be able to couple both devices and to be able to drive both devices individually and also independently of one another.

In an advantageous embodiment it is provided that the lifting apparatus has an upper cover. This upper cover is arranged at an upper end of the upper lifting segment of the lifting unit. In particular, the upper cover is arranged at an upper end of an upper housing segment of the housing of the lifting unit. This cover has a through-hole. The tilting device extends through this hole. In particular, a guide for the tilting device is configured by this hole. The tilting device is thus guided through this hole when moved upwardly and moved downwardly. Preferably, it is provided that the tilting device is guided relatively accurately, in particular with minimum clearance, through this hole. As a result, undesired tilting movements of this tilting device are avoided. As a result, the particularly linear movement in the vertical direction is made possible for the tilting device.

In particular, a plate receiver for the insert plate is configured on the upper region of the upper lifting segment. For example, this plate receiver may be implemented as an injection-molded component, in particular as a 2K injection-molded component. It may be provided that at least one through-hole is located in this plate receiver. An actuating element may extend through this through-hole from below, a support vane positioned on the plate receiver being able to be lifted thereby. In particular, a pivoting about a horizontal pivot axis may be carried out by this lifting so that a support vane may be positioned obliquely and thus in a tilted manner. Preferably, such a hole or a feedthrough in the plate receiver is covered in the upper region by a resilient cover. As a result, it is possible to avoid the situation where media could pass from above into this hole in the plate receiver. Since this cover is configured in a resilient manner, the actuating element may act on this resilient element and bulge it upwardly. Thus a corresponding actuating force may also be transmitted to the support vane and this may be tilted.

In an advantageous embodiment it is provided that an upper face of the insert plate has a surface which is at least 80 percent, in particular at least 90 percent, in particular at least 95 percent, of the surface of the receiving space in a horizontal plane. The surface of the upper face of the insert plate, however, is less than 99 percent of this surface of the receiving space. By such a dimensioning, the insert plate is configured over virtually the entire surface area relative to the clear width of the receiving space between the side walls, and thus fills up this receiving space virtually entirely when viewed in the horizontal plane. On the other hand, however, a small gap, in particular of between 3 mm and 15 mm, in particular of between 3 mm and 10 mm, is permitted over the periphery so that, on the one hand, the relative movement of the insert plate may be carried out unhindered when setting the position or changing the position. In particular, as a result, this avoids direct contact and a side edge of the insert plate optionally scraping along the inner faces of the side walls. Thus, on the one hand, damage to the side walls is avoided and, on the other hand, damage to the insert plate and also to the lifting apparatus is avoided. Last but not least, it is also advantageously achieved by this embodiment that liquid which is present on the upper face of the insert plate may be drained in a simple manner into the receiving space through this gap between the edge of the insert plate and the inner faces of the side walls.

Preferably, the basin has a drain, in particular on the bottom wall. As a result, a medium which is arranged in the basin and collects therein may drain out easily via the drain.

In particular, the basin is configured in one piece with the bottom wall and the side walls. In particular, the basin is configured from metal.

The bottom wall may be flat or slightly inclined or slightly bulged. In particular, it is provided that the point of the bottom wall at which an outlet for a drain of the sink is configured is offset furthest toward the bottom relative to the vertical position.

It may be provided that the upper face of the plate is configured to be entirely flat. However, the upper face may also be slightly curved. It is also possible that the upper face of the insert plate is structured at least in some regions. As a result, a certain roughness may be generated. As a result, it is possible to avoid in an improved manner undesired slippage of objects positioned thereon. For example, this is advantageous when a change in the position of the insert plate occurs and objects are still arranged on the upper face of the insert plate. It is also possible that the upper face has specific positioning regions. These may be recesses. However, such recesses may be configured to be relatively small, for example. This is advantageous in order to be able to position, for example, vessels such as a glass or the like securely. In particular, this is advantageous when a change in the position is tilting and/or rotating. An undesired slippage of such vessels is thus avoided. Moreover, it is also achieved by such predetermined positioning regions, for example, that when vessels are positioned on the upper face of the insert plate and, for example, are designed to be filled via the faucet, the water running out of the faucet flows accurately into the vessels with a rotational movement and does not run over the circumference of the containers onto the insert plate.

The lifting apparatus may have a lifting unit and a motor. The lifting unit may be moved by the motor at least in the vertical direction.

The positions and orientations provided when the sink is used as intended and arranged as intended are specified by the terms "top", "bottom", "front" "rear" "horizontal", "vertical", "depth direction", "width direction", "vertical direction".

Further features of the invention emerge from the claims, the figures and the description of the figures. The features and combinations of features mentioned above in the description, as well as the features and combinations of features mentioned below in the description of the figures and/or shown individually in the figures are not only able to be used in the respectively specified combination but also in other combinations or individually without departing from the scope of the invention. Thus embodiments of the invention which are not explicitly shown and described in the figures but which emerge from and which may be generated by separate combinations of features from the described embodiments are also to be regarded as encompassed and disclosed. Embodiments and combinations of features which thus do not have all of the features of an originally formulated independent claim are also to be regarded as disclosed.

BRIEF DESCRIPTION OF THE DRAWINGS

Exemplary embodiments of the invention are described hereinafter in more detail with reference to schematic drawings. In the drawings.

DETAILED DESCRIPTION OF EXEMPLARY EMBODIMENTS OF THE PRESENT INVENTION

Figure 1:
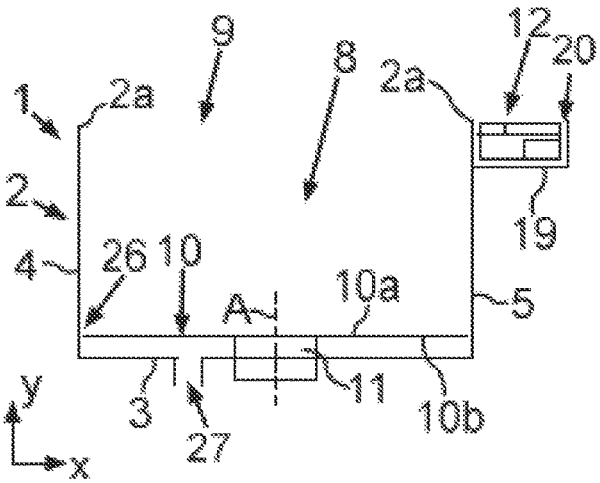
FIG. 1 shows a schematic sectional view through an exemplary embodiment of a sink according to the invention with an insert plate in a first position.

Elements which are the same or functionally the same are provided with the same reference characters in the figures.

Figure 3:
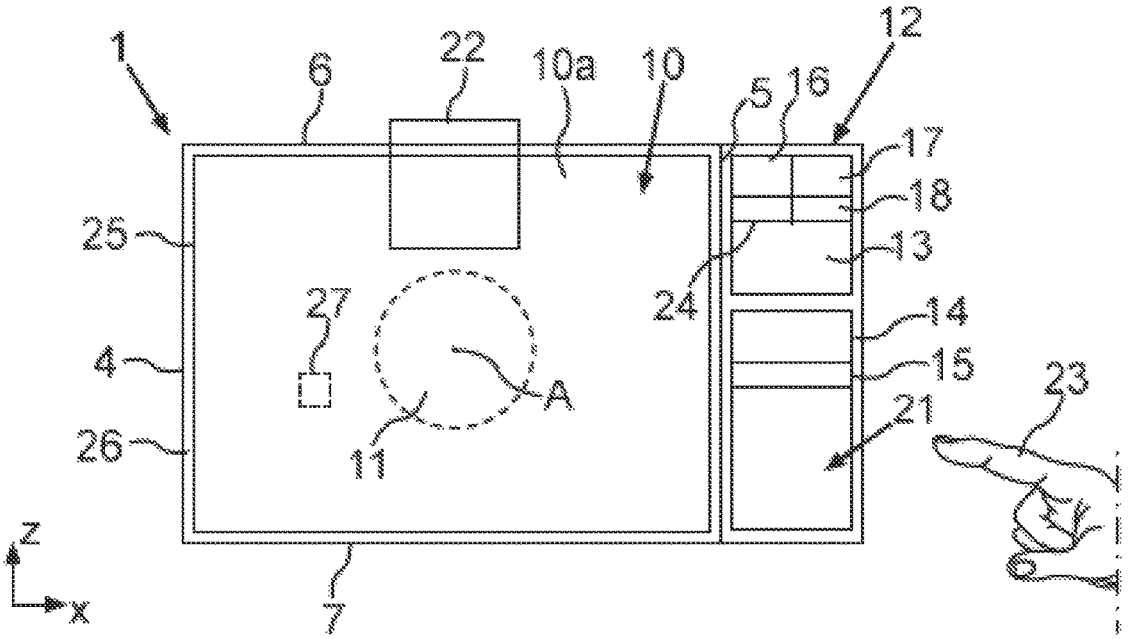
FIG. 3 shows a plan view of an exemplary embodiment of a sink.

A sink 1 is shown in FIG. 1 in a schematic vertical sectional view (x-y plane with the vertical direction y and width direction x). The sink 1 has a basin 2. The basin 2 has a bottom wall 3 and adjoining and upwardly extending side walls 4, 5, 6 (FIG. 3) and 7 (FIG. 3). The basin 2 is configured, in particular, in one piece. The basin is preferably configured from metal. The basin 2 has a receiving space 8. The receiving space 8 is delimited by the aforementioned walls 3 to 7. Thus the basin 2 has an upper loading opening 9. The sink 1 also has an insert unit. The insert unit is, in particular, an insert plate 10. The insert plate 10 is configured, in particular, in one piece. The insert plate 10 is a component of the sink 1 which is separate from the basin 2. The sink 1 also has a lifting apparatus 11. The insert plate 10 is arranged on the lifting apparatus 11. In particular, the insert plate is arranged on the lifting apparatus 11 such that it can be released in a non-destructive manner. The insert plate 10 is movable relative to the basin 2 by the lifting apparatus 11. In this context, a movement may take place in the vertical direction (y-direction) of the sink 1. Additionally or alternatively, a rotation may take place about a vertical axis A of the lifting apparatus 11. Additionally or alternatively, a tilting of the insert plate 10 may take place. This means that the insert plate 10 may be set with its plane at an angle to a horizontal plane. It may thus be positioned in an inclined or oblique manner. In FIG. 1 the insert plate 10 is shown in an exemplary position in the receiving space 8. In particular, this is a position which has been moved downwardly. In this regard, the insert plate 10 is arranged directly adjacent to the bottom wall 3.

Preferably, the sink 1 has an interaction unit 12. The interaction unit 12 may have a display unit 13 (FIG. 3). The interaction unit 12 may have an operating apparatus 14. The operating apparatus 14 may have one or more operating elements. The operating elements may be push buttons or switches or toggle elements or rotary knobs. The operating apparatus 14, however, may also additionally or alternatively have a touch-sensitive operating panel 15. In an advantageous embodiment it may be provided that the interaction unit 12 has at least one optical detection unit 16. The optical detection unit 16 may, for example, be a camera. The camera may be sensitive in the spectral range visible to humans. The interaction unit 12, however, may also additionally or alternatively have an acoustic unit 17. This acoustic unit 17 may be configured for the reception and/or for the output of speech signals. Moreover, the interaction unit 12 may have an identification unit 18. The identification unit 18 is configured for identifying, or for the identification of, a user of the sink 1. The identification unit 18 may also be formed, for example, by the optical detection unit 16. Additionally or alternatively, however, the identification unit 18 may also, for example, have the acoustic unit 17. As a result, for example, the user may be identified by the evaluation of a speech signal of a user. Additionally or alternatively, the identification unit 18 may be configured as a unit for detecting and evaluating a biometric feature of a user. For example, this may be a fingerprint sensor or a sensor for identifying an iris pattern.

Figure 2:
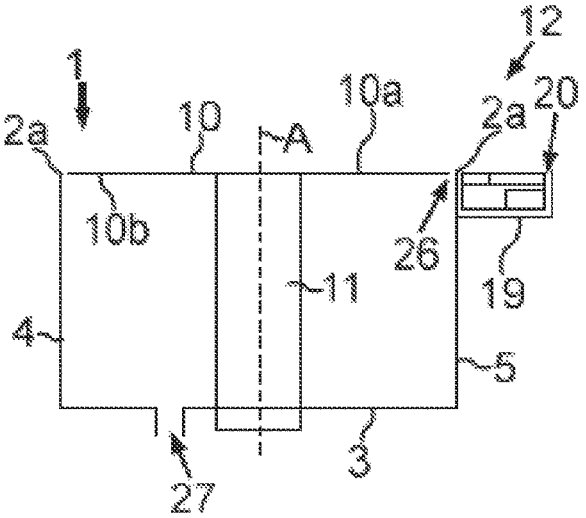
FIG. 2 shows the view of the sink according to FIG. 2 with the insert plate in a second position which is different from FIG. 1.

As may be identified in FIGS. 1 to 3, the interaction unit 12 may be configured at the side and directly adjacent to the basin 2. For example, a receiving housing 19 which is open at the top may be provided here. The receiving housing 19 may be configured separately from the basin 2. However, it may also be formed with the basin 2 such that it cannot be released in a non-destructive manner. In particular, the receiving housing 19 may also be configured in one piece with the basin 2. The side wall directly adjoining the receiving housing 19, in the example here the side wall 5, also forms a defining wall for the receiving volume 20 of the receiving housing 19.

Thus the receiving volume 20 is separated from the receiving space 8 of the basin.

In FIG. 2 the view according to FIG. 1 is shown, but the insert plate 10 is shown in a different position from FIG. 1. In FIG. 2 the insert plate 10 is oriented horizontally but moved upwardly. In particular, this position represents the maximum possible vertical position. In particular, in this position an upper face 10*a* of the insert plate 10 is flush with an upper edge 2*a* of the basin 2. In particular, in this position, the insert plate 10 forms a cover or a lid for the receiving space 8. This upper edge 2*a*, however, may also be for example an upper face of a mounting frame or a decorative frame which is a constituent part of the sink 1. The sink 1, in particular the basin 2, may be mounted with the mounting frame in a cutout of a worktop. The basin 2 may be covered from above with a decorative frame. A gap between the basin 2 and a defining wall in the worktop, which defines the cutout, thus may be covered from above. Such a decorative frame, in particular, represents an upper visible component of the arrangement.

In particular, the sink 1 also has a control unit 21 (FIG. 3). The lifting apparatus 11 may be operated by the control unit 21. In particular, the interaction unit 12 may also be operated by the control unit 21.

The sink 1 may preferably also have a faucet 22, as may be identified in the simplified plan view in FIG. 3. The faucet 22 represents a functional unit of the sink 1. The interaction unit 12, in particular the operating apparatus 14, may also be viewed as a functional unit of the sink 1. A further functional unit of the sink 1 may be the insert plate 10. A further functional unit of the sink 1 may be the lifting apparatus 11.

The lifting apparatus 11 preferably has a lifting unit and a motor. As a result, the lifting apparatus may be changed in terms of its length or height in the direction of the vertical axis A. Moreover, the lifting apparatus may be additionally or alternatively rotated about the vertical axis A. As a result, a rotational movement about this vertical axis A is also possible as a position, or as a change in the position, of the insert plate 10. Last but not least, the lifting apparatus 11 may also be set such that the insert plate 10 may be set in an oblique or inclined manner relative to a horizontal plane.

An operating state of the sink 1 may be identified and/or a change in the operating state of the sink 1 and/or an operation of a user who operates the sink 1, in particular at least one functional unit of the sink 1, may be identified by the interaction unit 12. Depending on the identification by the interaction unit 12, the lifting apparatus 11 is able to be operated for automatically changing the position of the insert plate 10. In FIG. 3 a schematic view of a finger 23 of a user is also shown. The interaction unit 12 is preferably configured for detecting a gesture of the user, in particular of the finger 23. In particular, the gesture is a contactless gesture. Additionally or alternatively, however, a direct operation of the operating apparatus 14 may also be carried out with the finger 23. It is provided that an operating state and/or a change in the operating state may be detected by the camera 16 and/or the acoustic unit 17 and/or the operating apparatus 14. An operating state may be, for example, a setting of the operating apparatus 14 and/or a change in the operating state may be a change in the setting of the operating apparatus 14.

A change in the position of the insert plate 10 may be dependent on the type and/or intensity and/or duration of an operating state of at least one functional unit of the sink 1 and/or a change in the position may be dependent on the type and/or intensity and/or duration of a change in the operating state of at least one such functional unit of the sink 1.

The interaction unit 12 has a normal mode. The actual operation of the sink 1 is also detected in this normal mode. Moreover, the interaction unit 12 has a defining mode which is different from the normal mode. This defining mode may be set, for example, by a user. In this defining mode it is possible that at least one user defines or predetermines at least one reference position of the insert plate 10. In particular, in this defining mode such a reference position may be linked with a specific operating state of at least one functional unit of the sink 1 and/or with a defined change in the operating state of at least one functional unit of the sink 1. At least one such reference position may be stored as a user profile in a memory unit 24 of the interaction unit 12.

In an advantageous embodiment it is provided that the surface shown in FIG. 3 (depth direction z and width direction x) of the upper face 10*a* is at least 80 percent, in particular at least 90 percent, in particular at least 95 percent, of the surface of the receiving space 8 which is viewed in a horizontal plane (in FIG. 3 the plane of the figures). In particular, however, this surface of the upper face 10*a* is less than 99 percent of this surface of the receiving space 8 in the aforementioned horizontal plane. As a result, it is achieved that a peripheral edge 25 of the insert plate 10 is spaced apart from the side walls 4, 5, 6 and 7. In particular, a peripheral gap 26 between the insert plate 10 and the side walls 4 to 7 is formed thereby. The gap 26 may be between 3 mm and 15 mm. Preferably, this gap 26 is sufficiently small, at least in the horizontal position of the insert plate 10, that objects such as cutlery or the like are not able to slip through. Moreover, it is thus possible to avoid a finger 23 being trapped in this horizontal position of the insert plate 10.

As is also shown in FIGS. 1 to 3, the sink 1 has an outlet opening 27, for example a drain. This outlet opening is configured, in particular, in the bottom wall 3. Media may drain out of the receiving space 8 from the basin 2 through this outlet opening 27.

Figure 4:
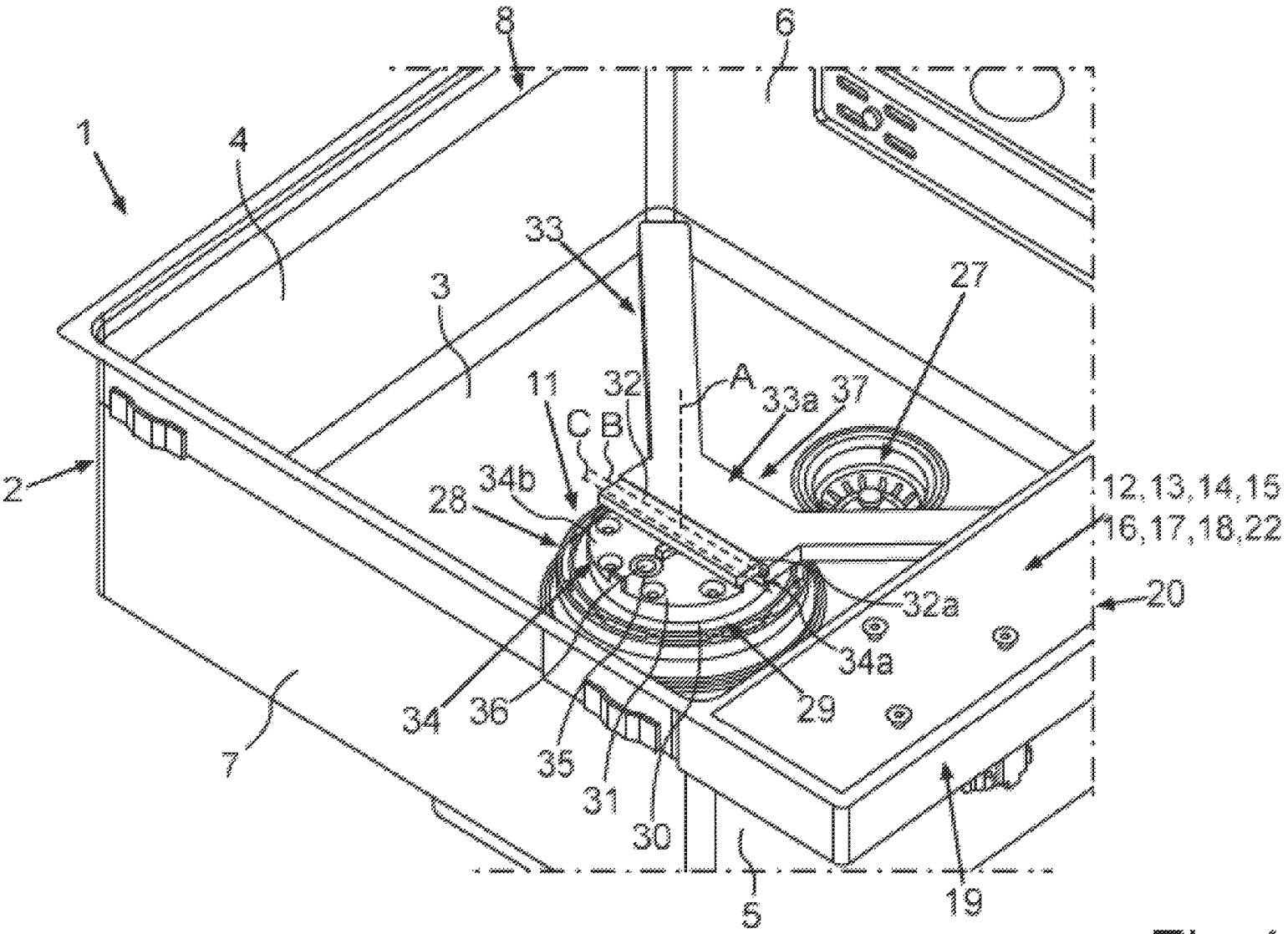
FIG. 4 shows a perspective partial view of an exemplary embodiment of a sink with an exemplary embodiment of support vanes of a lifting apparatus.

An exemplary embodiment of a sink 1 is shown in FIG. 4 in a perspective view. The lifting apparatus 11 is shown. The lifting apparatus 11 has a lifting unit 28. This lifting unit is fastened, in particular, centrally in the middle of the bottom wall 3. The lifting unit 28 is movable in the direction of the axis A. In this context, the lifting unit 28 has a plurality of lifting segments. The lifting unit 28 is shown in the fully retracted state in FIG. 4. This means that it is retracted to a maximum extent downwardly into the receiving space 8. Preferably, this lifting unit 28 has an upper lifting segment which is formed by an upper housing element 29 of a housing 40 of the lifting unit 28. A plate receiver 31 is arranged in an upper region 30 of this upper lifting segment. The plate receiver 31 in this case is a flat cylindrical disk. This plate receiver 31 has a central projection 32. A first support vane 33 is arranged on this central projection 32. In particular, the support vane 33 is mounted on the central projection 32 so as to be pivotable about a horizontal axis B. The one-piece support vane 33 is positioned from above on the plate receiver 31. An upper face 34 of this plate receiver 31 has upper face regions 34*a* and 34*b*. These upper face regions are offset downwardly relative to the central projection 32. The support vane 33 is positioned on this upper face region 34*a*. For the sake of improved clarity, a second support vane which is separate from the first support vane 33 but in particular has the same size and the same shape is arranged. This second support vane is mounted on the central projection 32 so as to be pivotable about a further horizontal axis C. The horizontal axes B and C are oriented parallel to one another. The second support vane is positioned from above on the second upper face region 34*b*. In the horizontal basic position, an upper face 33*a* of the support vane 33 is flush with an upper face 32*a* of the central projection 32. Accordingly, this is configured with an upper face of the second support vane.

The support vane 33 and the second support vane, not shown, are arranged spaced apart from one another by the central projection 32. They may be pivoted independently of one another about their axes B and C. Thus individual tilted positions of a support vane 33 may also be set relative to the horizontal plane. In particular, the plate receiver 31 also has a through-passage 35. An actuating element may extend from below through the plate receiver 31 through this through-passage, and thus in this case come into contact with the second support vane from below and lift it up, so that it is pivoted about its horizontal axis C. Accordingly, a further through-passage which is below the first support vane 33 is configured on the side opposing the through-passage 35. This may also be accordingly lifted, as has been described above. Preferably, it is provided that the through-passage 35 is covered from above by a resilient cover 36. The resilient cover 36 permits the actuating element to be able to protrude through the through-passage 35 and to be positioned further up relative to the upper face region 34*b*, and a corresponding protruding of the actuating element may result due to the resilient deformation of the resilient cover 36. As a result, the corresponding second support vane may also be lifted.

The plate receiver 31 is configured with the cover 36 as a 2K injection-molded component.

Figure 5:
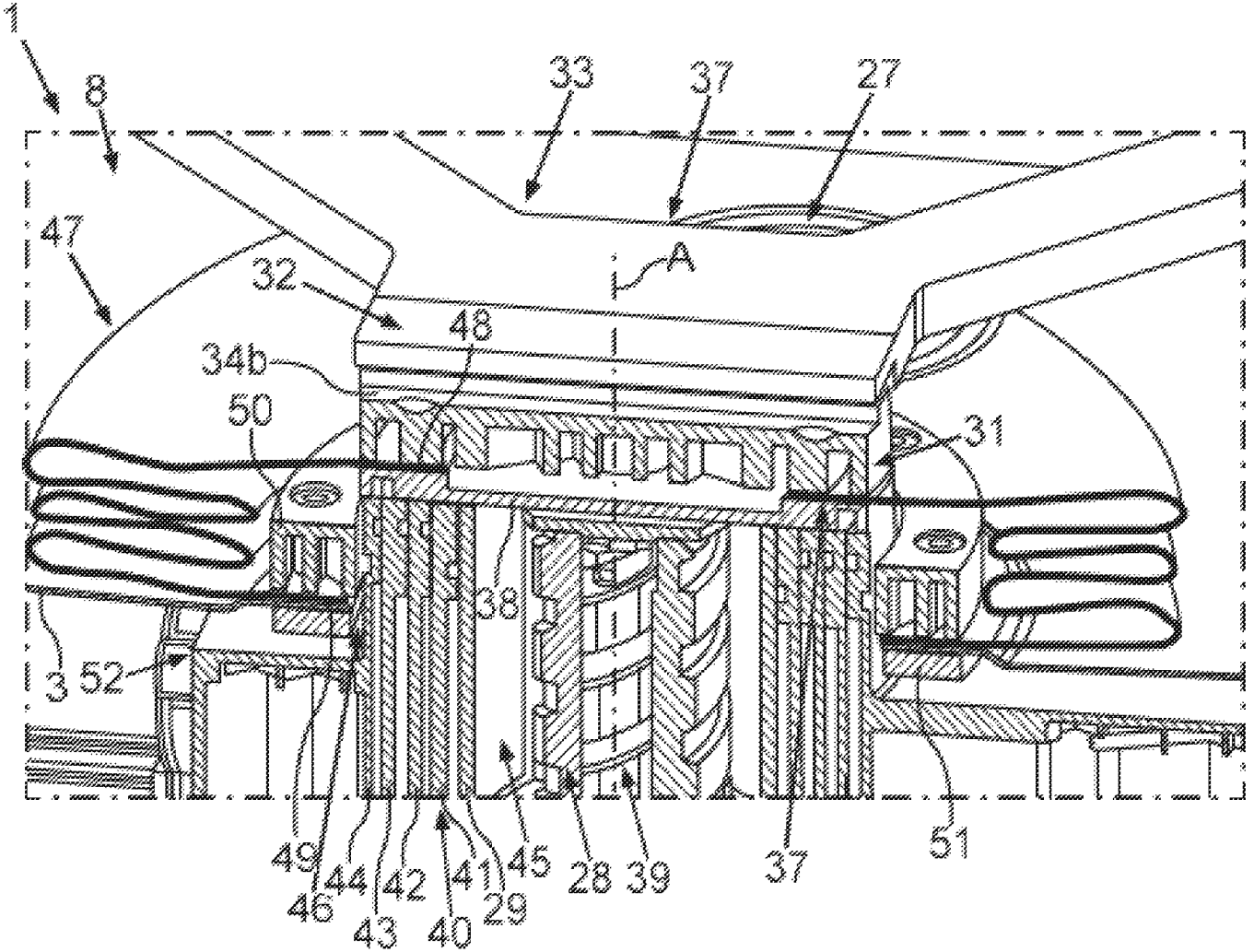
FIG. 5 shows a perspective sectional view of a partial region of the arrangement in FIG. 4 with a sealing sleeve around a lifting unit of the lifting apparatus.

A partial region of the arrangement in FIG. 4 is shown in FIG. 5 in a perspective sectional view.

It may be identified that the plate receiver 31, which is configured as a flat cylinder, is positioned from above on an upper face 37 of the upper lifting segment of the lifting unit 28. This upper face 37 is, in particular, an upper face of an upper cover plate 38.

The lifting unit 28 has a lifting device 39. The lifting device 39 may be a spindle drive. However, it may also be a feed chain, for example. The lifting unit 28 also has a housing 40. The housing 40 surrounds this lifting device 39 over the circumference. The housing 40 is, in particular, a telescopic housing. This means that it has a plurality of housing segments. In the exemplary embodiment, these lifting segments are configured as hollow cylinders. In the exemplary embodiment an upper housing segment 29 is configured in an extended state, a second housing segment 41 following downwardly, a further housing segment 42 following downwardly, a further housing segment 43 following downwardly and then a lower housing segment 44. The fully retracted position of the lifting unit 28 is shown in FIG. 5. The lifting unit 28 is thus moved entirely downward. In this state the housing 40 is fully telescoped and in a vertically minimized position. The housing segments 29 and 41 to 44 are thus fully telescoped as shown in FIG. 5. If the lifting unit 28 is extended out of this downwardly moved state in which the insert plate 10 is also arranged in the lowered position, and thus moved upwardly, the housing segments 29 and 41 to 44 are pulled apart. This is shown by way of example in the sectional view of a further exemplary embodiment of the sink 1 in FIG. 6. The lifting device 39 is arranged in an interior 45 of this housing 40. The lifting unit 28 extends through a through-passage or feedthrough 46 in the bottom wall 3. The lifting unit 28 is thus arranged on either side of this bottom wall 3.

Moreover, the lifting apparatus 11 has a sealing sleeve 47. The sealing sleeve 47 is a separate component from the housing 40. The sealing sleeve 47 surrounds that partial region which extends over the circumference in the receiving space 8 of the lifting unit 28. The sealing sleeve 47 is resiliently configured. The sealing sleeve may be configured in one piece. The sealing sleeve may be configured, for example, as a folding bellows. However, other specifications are also possible in terms of material and geometry.

In FIG. 5 the sealing sleeve 47 is configured as a folding bellows. In FIG. 5 the sealing sleeve is shown in the fully compressed or folded state. The sealing sleeve 47 has an upper edge 48. In the exemplary embodiment shown, the upper edge 48 is clamped between the plate receiver 31 and the cover 38. In particular, this upper edge 48 is also arranged so as to form a seal between the plate receiver 31 and the cover 38. The cover 38 may also be denoted as a lifting plate.

Moreover, this sealing sleeve 47 has a lower end 49. This lower end 49 is positioned directly on the inner face of the bottom wall 3. Moreover, it is provided that the sink 1 has an adapter 50. This adapter 50 is preferably a separate component. The adapter 50 is preferably designed as a circumferential adapter ring which is configured without interruption. The adapter 50 is positioned from above on this lower edge 49 of the sealing sleeve 47. As may be identified, the lower edge 49 is clamped between this adapter 50 and the bottom wall 3. In particular, a sealed clamping is also configured here.

In particular, the adapter 50 is fastened to the bottom wall 3 such that it can be released in a non-destructive manner, in particular screwed by screw connections. To this end, for example, a counter bearing 51 may be arranged below the bottom wall 3. This counter bearing 51 may be a bearing ring. At the same time, the counter bearing may be configured as an acoustic damping unit.

A seal 29*a* may be arranged between the adapter 51 and an outer face of the housing segment 44.

In FIG. 5 a receiving housing 52 of the lifting apparatus 11 is also shown. The receiving housing 52 is arranged below the bottom wall 3 and thus outside the receiving space 8. The housing 40 is received in this receiving housing 52. Moreover, the lifting device 39 is also partially received on this receiving housing 52. In particular, the receiving housing 52 is fastened by a plurality of fastening elements to the lower face of the bottom wall 3 and thus suspended thereon. It may be provided that a lower housing segment 44 of the housing 40 is configured in one piece with the receiving housing 52. In this embodiment, as also shown in FIG. 5, the receiving housing 52 extends through the feedthrough 46 only with this housing segment 44 of the housing 40.

In the exemplary embodiment according to FIG. 5 the lifting device 39 is configured as a spindle drive.

Figure 6:
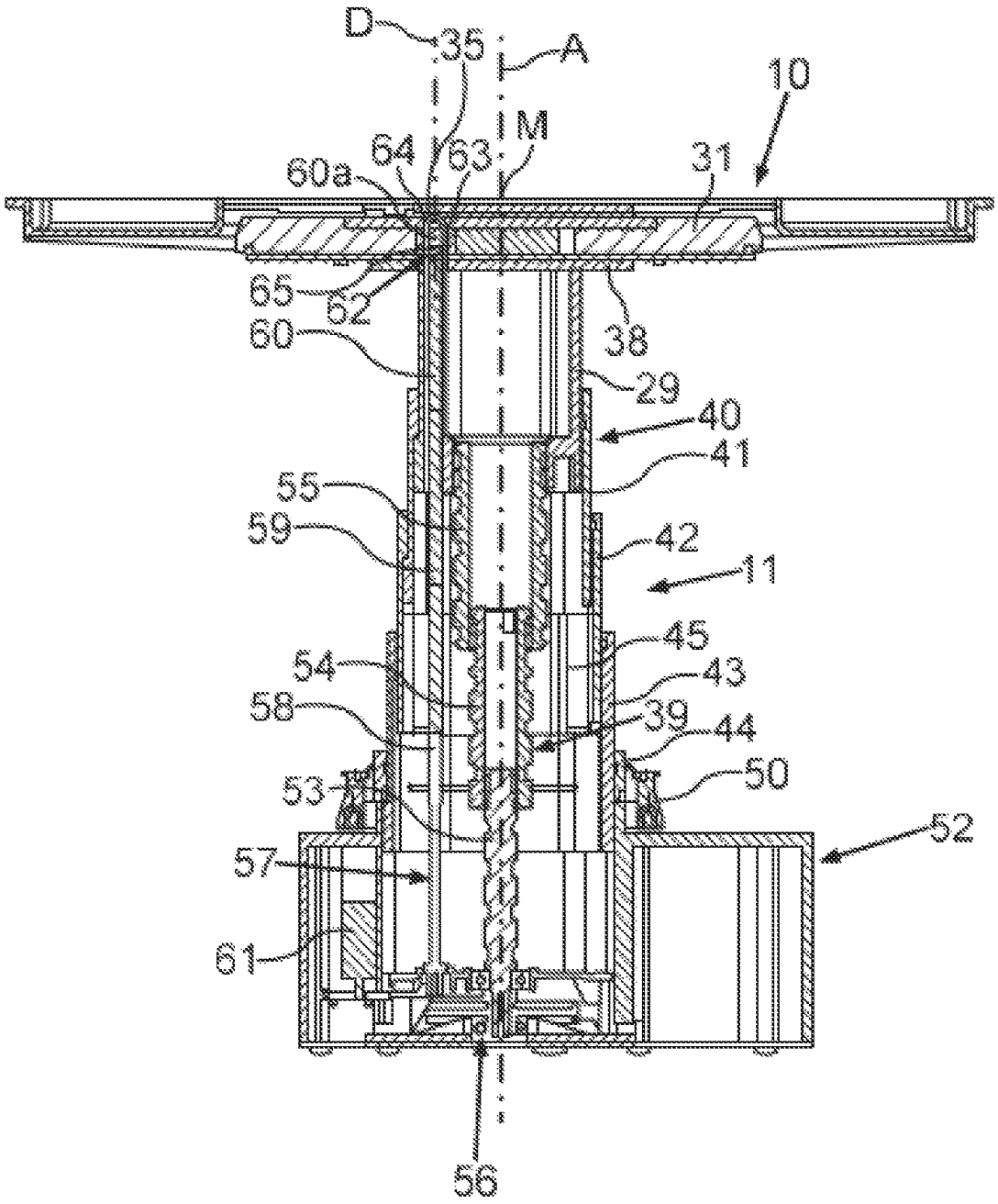
FIG. 6 shows a sectional view of a lifting apparatus of the sink with a sectional view of a tilting device for tilting the insert plate.

The lifting apparatus 11 is shown in the fully extended state, and thus with a maximum length when viewed in the vertical direction, in a vertical sectional view in FIG. 6. In addition, the lifting unit 28 is accordingly moved apart. This also means that the housing 40, which is a telescopic housing, is moved apart to a maximum extent. The lifting device 39 which is arranged in the interior 45 of the housing 40 is also shown in the pulled-apart state. In particular, spindles 53, 54 and 55 which are a constituent part of the exemplary spindle drive are shown here. The lifting apparatus 11 has a motor 56. This motor 56 is a first motor. It is entirely arranged in the receiving housing 52. This first motor 56 is provided for driving the lifting device 39.

Moreover, the lifting apparatus 11 has a tilting device 57. The tilting device 57 is a separate device from the lifting device 39. A tilting movement of the insert plate 10 relative to the horizontal plane (x-z plane) may be carried out by the tilting device 57. The tilting device 57 is preferably arranged in the housing 40. In particular, the tilting device 57 is a rod which is oriented in the vertical direction. This rod is preferably arranged eccentrically to a central point M of the insert plate 10. The central point M is, in particular, on the axis A. In particular, this tilting device 57 is a telescopic rod. It is thus longitudinally adjustable in the vertical direction. In particular, the rod axis D thereof is oriented in the vertical direction.

Preferably, the tilting device 57 thus has at least two rod parts guided one inside the other, preferably a plurality of rod parts 57, 58, 59 and 60 guided one inside the other. Preferably, it is provided that these rod parts 58 to 60 are of conical configuration.

In particular, the lifting apparatus 11 has a second motor 61. The second motor 61 is arranged, in particular, in the receiving housing 52. It is a further motor which is separate from the first motor 56. The second motor 61 is provided for driving the tilting device 57. The second motor drives, in particular, only this tilting device 57. The first motor 56 drives, in particular, only the lifting device 39. In particular, it is provided that when the lifting device 39 is actuated and moves apart upwardly, the tilting device 57 is also pulled apart at the same time. Due to the preferably conical embodiment of the rod parts 58 to 60, with this upward moving apart, it is achieved that when one of these telescopic segments, in particular a rod part, is completely pulled out relative to the next, an anti-decoupling device is formed by the conical shape, and with a further upward movement this next telescopic segment, in the form of this next rod part, is pulled upwardly relative to the further rod part following downwardly. This takes place again until the anti-decoupling device acts and the next rod part is pulled upwardly again. Accordingly, this is also carried out when the rod parts are moved together and thus when lowered downwardly.

In an advantageous embodiment it is provided that the upper rod part 60 has at its upper end 60*a* a thread as a first thread. Preferably, a counter thread in the form of a second thread 63 may be provided. This is configured, in particular, in a plate following upwardly. This plate may be, for example, the plate receiver 31. If the second motor 61 is actuated, the tilting device 57 rotates and performs a linear movement due to these coupled threads 62 and 63. Preferably, it is provided that a pressure piece 64 forms the entire upper end of the upper rod part 60. This pressure piece 64 may be resiliently configured. In particular, it may be a rubber cap.

In an advantageous embodiment, it is provided that the cover 38 has a hole 65. The tilting device 57 extends through this hole 65. Preferably this hole 65 is formed such that it forms a guide for the tilting device 57.

In an advantageous embodiment it is provided that the rod parts 58 to 60, when viewed perpendicular to the rod axis D, are not configured to be rotationally symmetrical in the outer contour thereof. As a result, the rod parts 58 to 60 are secured against rotation relative to one another about this rod axis D. In particular, the tilting device 57 is configured in a separate bearing seat in a lower region. In particular, a ball bearing is also configured here.

In particular, it is provided that by the rotation about the rod axis D and, in particular, the threaded coupling of the two threads 62 and 63 the upper rod part 60 is moved upwardly in the through-passage 35 and protrudes upwardly. As a result, a contact of the lower face of the insert plate 10 or a contact of the lower face of the support vane 33 is made possible, in particular in the region 37. Thus by this upward movement of the upper rod part 60 beyond the level of the upper face of the plate receiver 31, the insert plate 10 is directly lifted, or the support vane 33 is lifted and the insert plate 10 then lifted therewith. As a result, the tilting movement of the insert plate 10 out of the horizontal position is brought about and thus a defined tilted position is set. In particular, it is provided that for a tilting movement the upper rod part 60 travels to a maximum extent upwardly beyond the level of the plate receiver 31 and this maximum projection path is less than 5 mm, in particular less than 4 mm, in particular between 2 mm and 4 mm.

As already described with reference to FIG. 4, the through-passage 35 may be covered at its upper end by the resilient cover 36. In such an embodiment, the upper rod part 60 pushes this resilient cover 36 upwardly when it moves upwardly through the through-passage 35, whereby in turn a corresponding lifting movement is exerted on the support vane 33 or in an alternative embodiment directly on the insert plate 10. A tilting movement is then initiated due to this action of eccentric force on the support vane 33 or the insert plate 10.

It may be provided that the plate receiver 31 is configured as a one-piece plastics component with the resilient cover 36 which is preferably present. For example, this may be a 2K injection-molded component. If the pressure piece 64 is present this may accordingly serve as a direct contact element with the support vane 33 or the insert plate 10. If this resilient cover 36 is present, this pressure piece 64 acts directly on this cover 36.

The embodiments in FIG. 5 and FIG. 6 may be configured differently or the same, in particular in the connecting region between the lifting unit 28 and the insert plate 10. In this regard, this may be provided relative to the cover 38 and/or the plate receiver 31. The support vane 33 may also be configured differently relative thereto. This is the case in the present example according to FIG. 5 and FIG. 6. Thus different exemplary embodiments are shown relative thereto.

Figure 7:
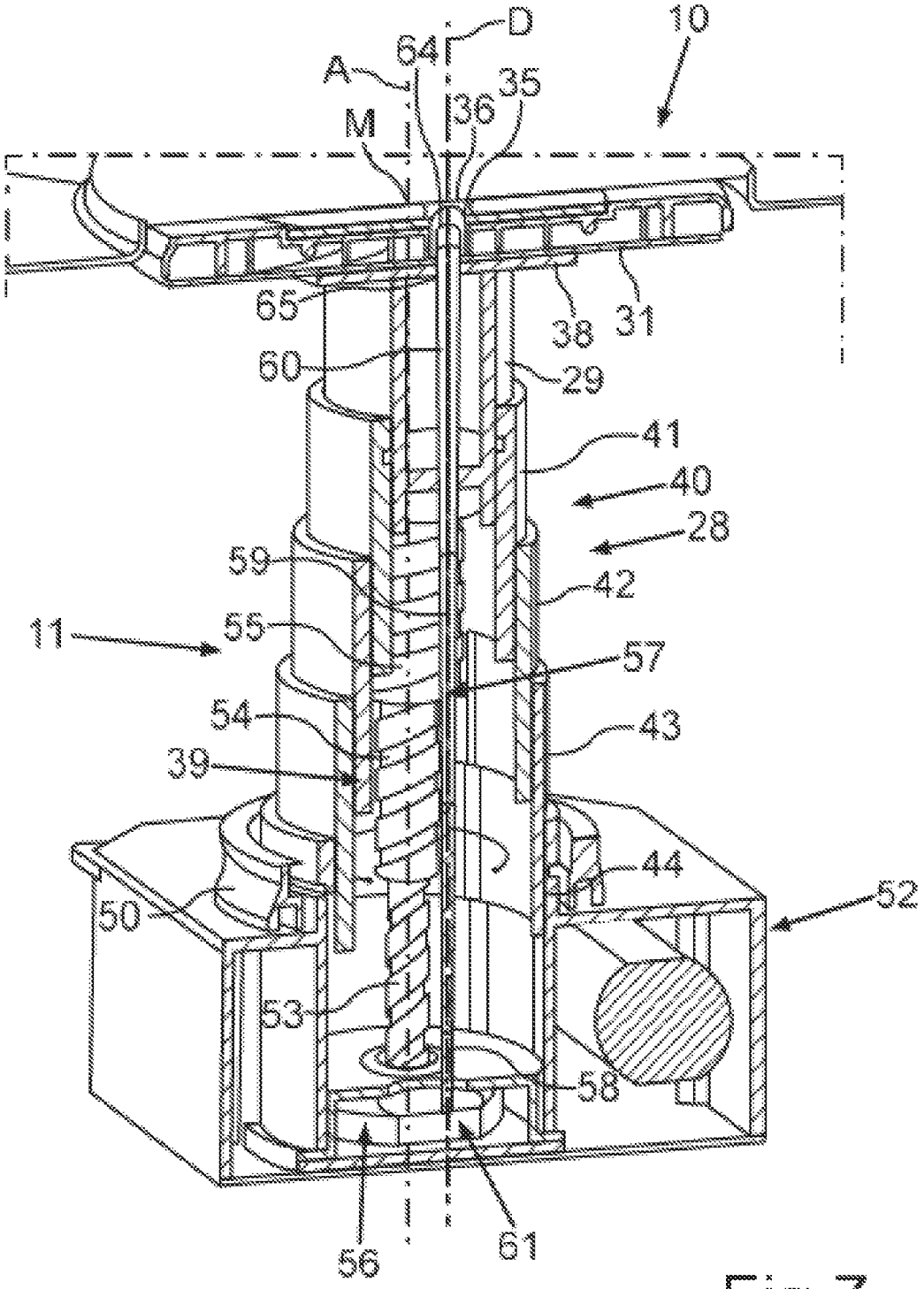
FIG. 7 shows a perspective sectional view of the embodiment in FIG. 6.

The embodiment according to FIG. 6 is shown in FIG. 7 in a perspective sectional view.

A dismantling mode which is different from the normal mode of the lifting unit 28 of the lifting apparatus 11 may also be set. In this dismantling mode, the lifting unit 28 is set in a position located even higher in the vertical direction above the maximum lifted position of the lifting unit 28 in normal mode and thus also the corresponding position of the insert plate 10. In the maximum lifted position in normal mode it is provided, in particular, that the upper face 10*a* of the insert plate 10 is flush with the upper face of the upper edge 2*a* of the basin 2 or a decorative frame or a mounting frame. In the dismantled position which is located higher for this purpose, the insert plate 10 is preferably positioned such that it is arranged with its lower face 10*b* higher than this upper edge 2*a* with a vertical spacing. In particular, this vertical spacing is at least 2 cm, in particular at least 3 cm. As a result, the insert plate 10 may be gripped on its edge 25 by a hand and securely held for removing from the lifting unit 28. The dismantling position is, in particular, a horizontal position of the insert plate 10. The lower face 10*b* of the insert plate 10 is thus positioned entirely above the upper edge 2*a*.

The invention claimed is:

1. A sink, comprising:

a basin including a bottom wall and adjoining side walls, said basin including a receiving space delimited by the bottom wall and the side walls;

an insert plate separate from the basin and inserted into the receiving space; and a lifting apparatus configured to move the insert plate relative to the basin, said lifting apparatus including a lifting unit with a lifting device to move the insert plate in a vertical direction, said lifting apparatus including a tilting device configured to perform a tilting movement of the insert plate relative to a horizontal plane.

2. The sink of claim 1, wherein the tilting device is configured separate from the lifting device.

3. The sink of claim 1, wherein the lifting unit includes a housing, said lifting device and said tilting device being arranged in the housing.

4. The sink of claim 1, wherein the tilting device is a rod which is oriented in the vertical direction and which is arranged eccentrically to a center point of the insert plate.

5. The sink of claim 1, wherein the tilting device is a telescopic rod which is longitudinally adjustable in the vertical direction.

6. The sink of claim 5, wherein the telescopic rod includes at least two rod parts which are guided one inside the other and which have a conical configuration.

7. The sink of claim 6, further comprising a plate, wherein an upper one of the at least two rod parts has at an upper end a first thread which engages in a second thread on the plate, so that the insert plate is tiltable about the horizontal plane by a thread adjustment when the upper one of the at least two rod parts is rotated about a vertical rod axis.

8. The sink of claim 7, wherein the lifting unit includes a housing having an upper lifting segment, said plate being a member selected from the group consisting of a plate receiver and a cover which is separate from the plate receiver, said member being arranged at an upper end of the upper lifting segment.

9. The sink of claim 8, wherein the upper lifting segment is formed by an upper housing segment of the housing of the lifting unit.

10. The sink of claim 7, wherein the second thread is configured in the plate, and further comprising a resilient cover to cover the second thread from above.

11. The sink of claim 7, wherein the at least two rod parts are configured with an anti-twist device to prevent a rotation relative to one another about the vertical rod axis.

12. The sink of claim 7, wherein the at least two rod parts are configured such as to have a shape which is not rotationally symmetrical about the vertical rod axis in order to prevent a rotation relative to one another about the rod axis.

13. The sink of claim 7, wherein the upper end of the upper one of the at least two rod parts has a pressure piece.

14. The sink of claim 13, wherein the pressure piece is resilient rubber cap.

15. The sink of claim 1, wherein the lifting apparatus includes a first motor to drive the lifting device and a second motor separate from the first motor to drive the tilting device.

16. The sink of claim 1, wherein the lifting unit includes a housing having an upper lifting segment, said lifting apparatus including a cover which is arranged at an upper end of the upper lifting segment, said cover having a hole for passage of the tilting device and guidance of a movement of the tilting device.

17. The sink of claim 16, wherein the cover is arranged at an upper housing segment of the housing.

18. The sink of claim 1, wherein the insert plate includes an upper face having a surface which is at least 80% of a surface of the receiving space in the horizontal plane but is less than 99% of the surface of the receiving space.

19. The sink of claim 1, wherein the insert plate includes an upper face having a surface which is at least 90% of a surface of the receiving space in the horizontal plane but is less than 99% of the surface of the receiving space.

20. The sink of claim 1, wherein the insert plate includes an upper face having a surface which is at least 95% of a surface of the receiving space in the horizontal plane but is less than 99% of the surface of the receiving space.

* * * * *